US009734972B2

(12) United States Patent
Fukuda et al.

(10) Patent No.: US 9,734,972 B2
(45) Date of Patent: Aug. 15, 2017

(54) ELECTROMAGNETIC RELAY

(71) Applicant: Panasonic Intellectual Property Management Co., Ltd., Osaka (JP)

(72) Inventors: Yoshihisa Fukuda, Osaka (JP); Kazuhiro Kodama, Hokkaido (JP); Junji Takahashi, Hyogo (JP); Hisashi Hiraki, Osaka (JP); Shuichi Katayama, Hyogo (JP); Tomohiro Ota, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/111,176

(22) PCT Filed: Feb. 4, 2015

(86) PCT No.: PCT/JP2015/000483

§ 371 (c)(1),
(2) Date: Jul. 12, 2016

(87) PCT Pub. No.: WO2015/122151

PCT Pub. Date: Aug. 20, 2015

(65) Prior Publication Data

US 2016/0336133 A1 Nov. 17, 2016

(30) Foreign Application Priority Data

Feb. 13, 2014 (JP) ..... 2014-025096

(51) Int. Cl.
*H01H 51/01* (2006.01)
*H01H 50/20* (2006.01)
(Continued)

(52) U.S. Cl.
CPC ..... *H01H 50/20* (2013.01); *H01H 50/36* (2013.01); *H01H 50/42* (2013.01); *H01H 51/01* (2013.01);
(Continued)

(58) Field of Classification Search
CPC ..... H01H 50/36; H01H 50/42; H01H 51/01; H01H 2051/2218; H01H 51/2227
(Continued)

(56) References Cited

U.S. PATENT DOCUMENTS 2,919,324 A * 12/1959 Schuessler ..... H01H 51/12 335/126
4,550,302 A 10/1985 Watanabe et al.
2009/0322453 A1 12/2009 Kawaguchi et al.

FOREIGN PATENT DOCUMENTS

JP 57-152736 U 9/1982
JP 58-072815 U 5/1983
(Continued)

OTHER PUBLICATIONS

International Search Report of PCT application No. PCT/JP2015/000483 dated May 12, 2015.

*Primary Examiner* — Ramon M Barrera
(74) *Attorney, Agent, or Firm* — Greenblum & Bernstein, P.L.C.

(57) ABSTRACT

An electromagnetic relay includes a contactor including a fixed contact and a movable contact, and an electromagnet device for moving the movable contact. The electromagnet device includes a coil generating a first magnetic flux by energization, a tubular body including a permanent magnet generating a second magnetic flux in a direction identical to a direction of the first magnetic flux and having a hollow extending in a center axis direction, a movable element disposed in the hollow of the tubular body and reciprocating in the center axis direction, and a yoke forming a magnetic circuit passing together with the movable element and the tubular body. The magnetic circuit allows at least one of the first and second magnetic fluxes to pass through the magnetic circuit. The electromagnet device is configured to, when the coil is energized, move the movable contact to a
(Continued)

first position by attracting the movable element with the first magnetic flux and the second magnetic flux. The electromagnet device is configured to, when energization of the coil is suspended, move the movable contact to a second position different from the first position. This electromagnetic relay is easily designed and reduces power consumption at a low cost.

10 Claims, 6 Drawing Sheets

(51) Int. Cl.
*H01H 51/22* (2006.01)
*H01H 50/36* (2006.01)
*H01H 50/42* (2006.01)

(52) U.S. Cl.
CPC .... *H01H 51/2209* (2013.01); *H01H 51/2227* (2013.01); *H01H 2051/2218* (2013.01)

(58) Field of Classification Search
USPC ..... 335/179, 229–234
See application file for complete search history.

(56) References Cited

FOREIGN PATENT DOCUMENTS

| | | |
|---|---|---|
| JP | 58-155706 | 9/1983 |
| JP | 59-086205 | 5/1984 |
| JP | 2010-010058 | 1/2010 |
| JP | 2011-003436 | 1/2011 |

* cited by examiner

ELECTROMAGNETIC RELAY

CROSS-REFERENCE TO RELATED APPLICATIONS

This application is a U.S. national stage application of the PCT international application No. PCT/JP2015/000483 filed on Feb. 4, 2015, which claims the benefit of foreign priority of Japanese patent application No. 2014-025096 filed on Feb. 13, 2014, the contents all of which are incorporated herein by reference.

TECHNICAL FIELD

The present invention relates to an electromagnetic relay, and more particularly to an electromagnetic relay that opens and closes a contactor with an electromagnet device.

BACKGROUND ART

Polar electromagnet devices including a permanent magnet are known. An electromagnetic relay including such an electromagnet device is disclosed in, e.g. PTL 1. A conventional electromagnetic relay disclosed in PTL 1 includes a contact mechanism unit including a fixed contact and a movable contact, and a driving mechanism unit including an electromagnet block (an electromagnet device). The electromagnet block has a spool, a driving shaft, a movable core, and a fixed core. A coil is wound around the spool. The driving shaft is inserted into a center hole of the spool and is reciprocatably moveable in a shaft center direction. The movable core is attached to one end of the driving shaft and is attracted to the fixed core upon energization of the coil. The movable core is provided unitarily with the permanent magnet on the same shaft center.

In this electromagnetic relay, a voltage applied to the coil moves the movable core to the fixed core due to a resultant force of an attractive force of the fixed core on the movable core and a repulsive force of the permanent magnet against a magnetic flux of the coil.

CITATION LIST

Patent Literature

PTL 1 Japanese Patent Laid-Open Publication No. 2010-010058

SUMMARY

An electromagnetic relay includes a contactor including a fixed contact and a movable contact, and an electromagnet device for moving the movable contact. The electromagnet device includes a coil generating a first magnetic flux by energization, a tubular body including a permanent magnet generating a second magnetic flux in a direction identical to a direction of the first magnetic flux and having a hollow extending in a center axis direction, a movable element disposed in the hollow of the tubular body and reciprocating in the center axis direction, and a yoke forming a magnetic circuit passing together with the movable element and the tubular body. The magnetic circuit allows at least one of the first and second magnetic fluxes to pass through the magnetic circuit. The electromagnet device is configured to, when the coil is energized, move the movable contact to a first position by attracting the movable element with the first magnetic flux and the second magnetic flux. The electromagnet device is configured to, when energization of the coil is suspended, move the movable contact to a second position different from the first position.

This electromagnetic relay is easily designed and reduces power consumption at a low cost.

DETAIL DESCRIPTION OF PREFERRED EMBODIMENT

Figure 1B:
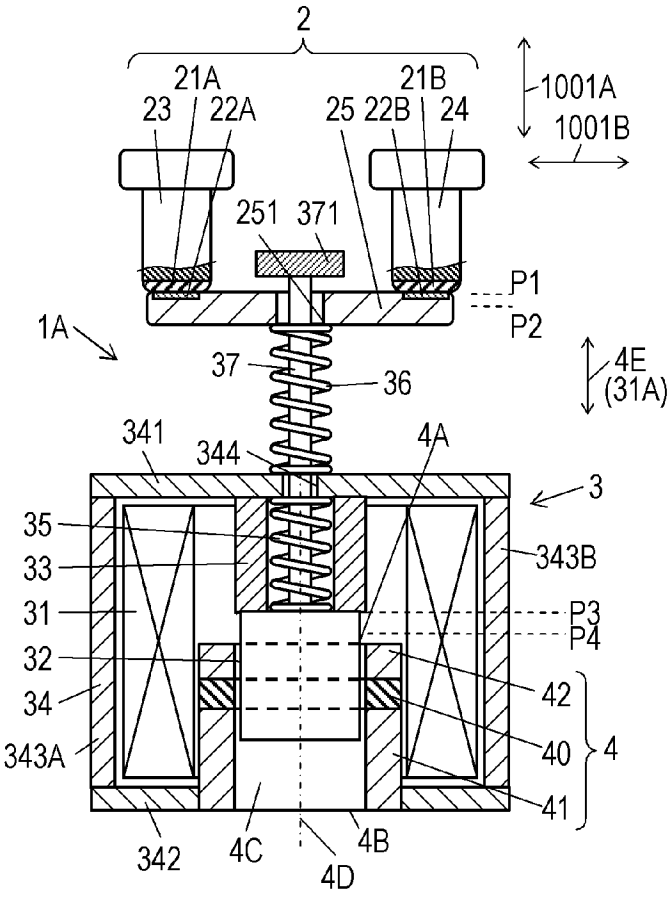
FIG. 1B is a schematic cross-sectional view of the electromagnetic relay according to the embodiment for illustrating the contacts closed.
Figure 1A:
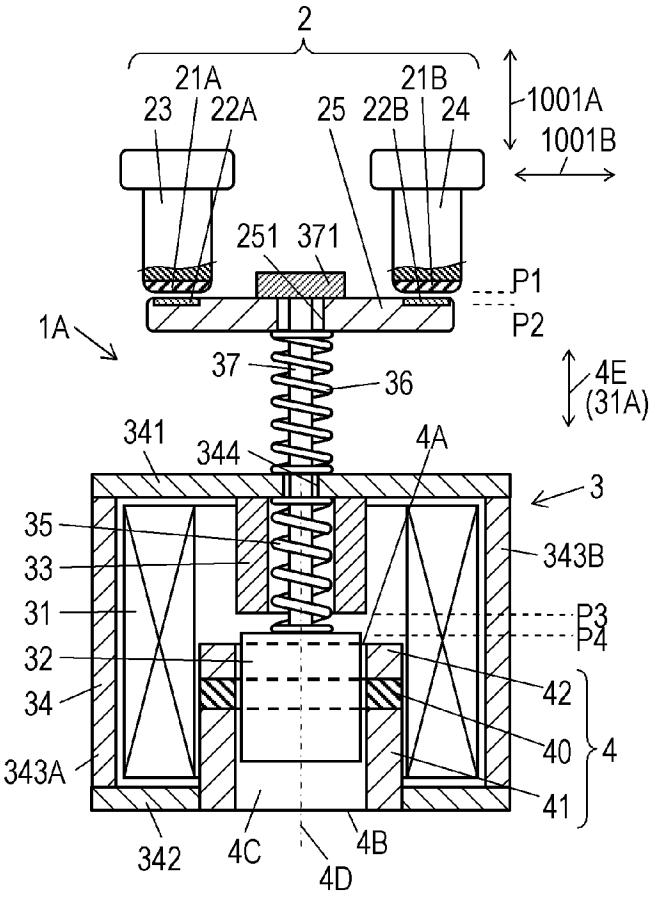
FIG. 1A is a schematic cross-sectional view of an electromagnetic relay according to an exemplary embodiment for illustrating contacts opening.

FIGS. 1A and 1B are schematic cross-sectional views of electromagnetic relay 1A according to an exemplary embodiment. Electromagnetic relay 1A includes contactor 2 and electromagnet device 3. Contactor 2 includes fixed contacts 21A and 21B and movable contacts 22A and 22B. Electromagnet device 3 includes coil 31, movable element 32, permanent magnet 40, yoke 34, and tubular body 4. Coil 31 is wound about a center axis extending in axial direction 31A. Tubular body 4 has hollow 4C therein extending along center axis 4D in center axis direction 4E. Hollow 4C of tubular body 4 has openings 4A and 4B open to the outside of tubular body 4. Opening 4A is positioned on center axis 4D. Opening 4B is positioned opposite to opening 4A on center axis 4D.

Figure 2:
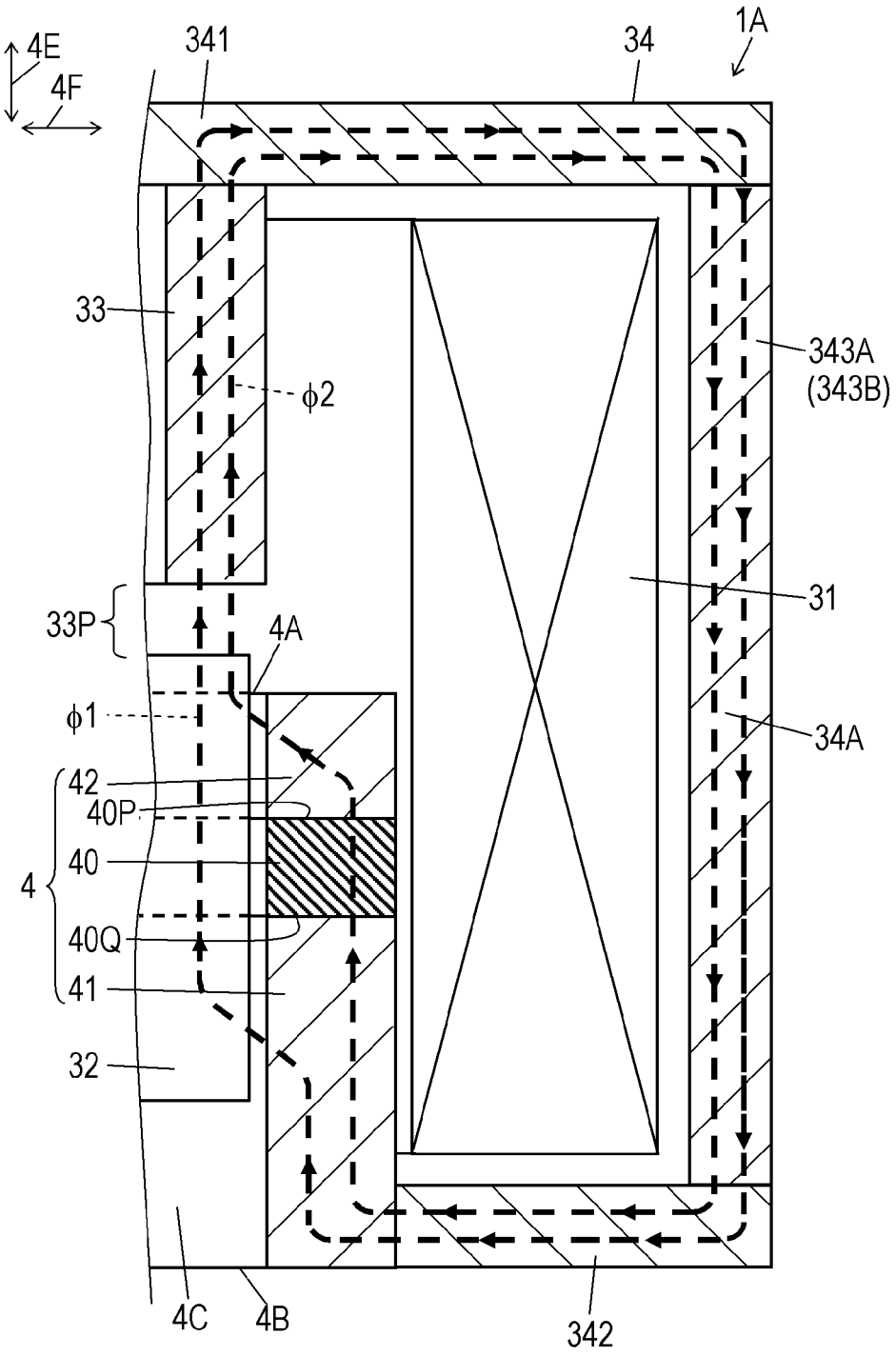
FIG. 2 is an enlarged cross-sectional view of the electromagnetic relay according to the embodiment for illustrating a flow of a magnetic flux.

FIG. 2 is an enlarged sectional view of electromagnetic relay 1A. Coil 31 generates magnetic flux $\phi$1 upon energization. Permanent magnet 40 generates magnetic flux $\phi$2 flowing in a direction identical to that of magnetic flux $\phi$1 in movable element 32. At least a part of movable element 32 is disposed inside hollow 4C of tubular body 4 and reciprocates in axial direction 31A of coil 31, namely, in center axis direction 4E of tubular body 4.

Yoke 34 forms magnetic circuit 34A together with stationary element 33 and movable element 32. Magnetic circuit 34A allows at least one of fluxes $\phi$1 and $\phi$2 pass through magnetic circuit 34A. Electromagnet device 3 attracts movable element 32 with magnetic fluxes $\phi$1 and $\phi$2 while coil 31 is energized, and moves movable contacts 22A and 22B to position P1 according to the attracting of movable element 32. That is, electromagnet device 3 is configured to move movable contacts 22A and 22B to position P1. Electromagnet device 3 is configured to move movable contacts 22A and 22B to position P2 different from position P1 when energization of coil 31 is suspended. Permanent magnet 40 constitutes at least a part of tubular body 4. Stationary element 33 is fixed with respect to yoke 34 and tubular body 4, and faces movable element 32 across gap 33P. Movable element 32 is movable with respect to stationary element 33, yoke 34, and tubular body 4. The direction of magnetic flux ϕ1 in gap 33P is identical to that of magnetic flux ϕ2 in gap 33P.

Electromagnetic relay 1A according to the embodiment will be detailed with referring to drawings. Electromagnetic relay 1A in the following description is simply an example and the disclosure is not limited to the embodiment described below; besides, various types of modifications may be added according to design requirements and other conditions within a scope that does not deviate from the technical concept of the present disclosure. In the following description, axial direction 31A of coil 31 agrees with upward and downward directions 1001A. Yoke part 341 is positioned above coil 31 while yoke part 342 is positioned below coil 31, where positional relationship defined by, e.g. "above" and "below" is not intended to limit an absolute orientation of electromagnetic relay 1A.

As shown in FIGS. 1A and 1B, electromagnetic relay 1A includes contactor 2 and electromagnet device 3. Contactor 2 includes a pair of fixed contacts 21A and 21B, a pair of movable contacts 22A and 22B, a pair of contact bases 23 and 24 supporting fixed contacts 21A and 21B, respectively; and movable contactor 25 supporting movable contacts 22A and 22B. Contactor 2 further includes a case accommodating fixed contacts 21A and 21B and movable contacts 22A and 22B therein between contactor 2 and yoke part 341 (described later). The case is made of, e.g. ceramics, and is has a box shape having an opening provided in a lower surface of the case. The outer circumferential periphery of the opening of the case is joined to the outer circumferential periphery of an upper surface of yoke part 341 via a coupler.

Contact bases 23 and 24 are made of conductive material. Each of fixed contacts 21A and 21B are provided on respective one of lower ends of contact bases 23 and 24. Contact bases 23 and 24 are arranged in right and left directions 1001B which is a direction in a plane perpendicular to upward and downward directions 1001A. Contact bases 23 and 24 have columnar shapes with cross sections having circular shapes in the plane. Contact bases 23 and 24 are joined to the case to be inserted into holes formed in a base plate (an upper wall) of the case.

Movable contactor 25 is made of conductive material and has a rectangular plate shape. Movable contactor 25 is disposed below contact bases 23 and 24 so that each of both ends of movable contactor 25 in a longitudinal direction thereof faces respective one of the lower ends of contact bases 23 and 24. Movable contactor 25 facing fixed contacts 21A and 21B provided on contact bases 23 and 24 includes movable contacts 22A and 22B.

Electromagnet device 3 drives and moves movable contactor 25 in upward and downward directions 1001A between positions P1 and P2. Position P1 is a closed position at which movable contacts 22A and 22B provided on movable contactor 25 contact fixed contacts 21A and 21B, respectively. Position P2 is an open position at which movable contacts 22A and 22B are separate from fixed contacts 21A and 21B, respectively. While movable contacts 22A and 22B are at the closed position (i.e., contactor 2 is closed), contact bases 23 and 24 are short-circuited via movable contactor 25. While movable contacts 22A and 22B are at an open position (i.e., contactor 2 opens), contact bases 23 and 24 open.

Electromagnet device 3 includes coil 31, movable element 32, stationary element 33, yoke 34, restoring spring 35, press-contact spring 36, shaft 37, and tubular body 4. Coil 31 generates magnetic flux ϕ1 upon energization. Tubular body 4 includes permanent magnet 40 that generates magnetic flux ϕ2 in a direction identical to that of magnetic flux ϕ1 upon energization. Electromagnet device 3 may include a coil bobbin made of synthetic resin having coil 31 wound around the coil bobbin.

Yoke 34 is made of magnetic material and surrounds coil 31. Yoke 34 includes yoke part 341, yoke part 342, and yoke parts 343A and 343B. Yoke parts 341 and 342 have rectangular plate shapes. Each of yoke parts 341 and 342 is provided on respective one of both sides of coil 31 opposite to each other in axial direction 31A (upward and downward directions 1001A). Yoke part 343A connects the left ends of yoke parts 341 and 342 with each other while yoke part 343B connects the right ends of yoke parts 341 and 342 with each other.

Tubular body 4 includes permanent magnet 40, tubular part 41, and tubular part 42, and has a cylindrical shape having hollow 4C therein extending along center axis 4D as a whole. Tubular body 4 is disposed inside coil 31 while a lower end of tubular body 4 is fit into a retaining hole formed in the central part of yoke part 342 and fastened to yoke part 342 (yoke 34). Tubular body 4 forms magnetic circuit 34A together with movable element 32, stationary element 33, and yoke 34. Magnetic circuit 34A allows at least one of magnetic fluxes ϕ1 and ϕ2 to pass through the magnetic circuit.

In electromagnetic relay 1A according to the embodiment, tubular body 4 has the cylindrical shape, which is not intended to limit the configuration to this shape. For example, tubular body 4 may have a shape, such as a box shape, with a cross section having a polygonal shape. Tubular body 4 does not necessarily have the cylindrical shape completely surrounding hollow 4C, and may have a gap extending in parallel with center axis 4D and partially opening in a side surface of the tubular body. In accordance with this embodiment, center axis 4D of tubular body 4 agrees with the center axis of coil 31. Tubular body 4 may be disposed such that center axis 4D of tubular body 4 is deviated from the center axis of coil 31.

Tubular part 41 is made of magnetic material and has a cylindrical shape. Permanent magnet 40 is fastened to an upper end of tubular part 41. Permanent magnet 40 is made of ferromagnet, such as neodymium magnet, samarium-cobalt magnet, alnico magnet, or ferrite magnet, and has an annular shape. These ferromagnets are just examples; other ferromagnets may be used to form permanent magnet 40. The outer and inner diameters of permanent magnet 40 are identical to those of tubular part 41. The term, "identical" may mean "substantially identical." The thickness of permanent magnet 40 in upward and downward directions 1001A is, e.g. not larger than 1 mm, smaller than that of tubular part 41 in upward and downward directions 1001A. This thickness is an example and is not intended to limit the thickness of permanent magnet 40 in upward and downward directions 1001A. The thickness of permanent magnet 40 in upward and downward directions 1001A may be not larger than that of tubular part 41 in upward and downward directions 1001A.

Tubular part 42 is fastened to an upper end of permanent magnet 40. That is, permanent magnet 40 is provided between tubular parts 41 and 42. Tubular part 42 is made of magnetic material and has a cylindrical shape. The outer and inner diameters of tubular part 42 are identical to those of tubular part 41. Here, the term "identical" may mean "substantially identical".

Coil 31 is disposed in a space surrounded by yoke 34. Movable element 32, stationary element 33, and tubular body 4 are disposed inside coil 31. Coil 31 generates, upon energization, magnetic flux ϕ1 passing through stationary element 33, yoke part 341, yoke part 343B (343A), yoke part 342, tubular body 4, and movable element 32 in this order. In electromagnetic relay 1A according to the embodiment, coil 31 is a solenoid coil, which is not intended to limit the configuration to this type.

Stationary element 33 is a fixed core having formed a cylindrical shape. An upper end of stationary element 33 is fastened to the central part of a lower surface of yoke part 341. According to this embodiment, a gap is provided between a lower end surface of stationary element 33 and an upper end surface of tubular part 42 in upward and downward directions 1001A. The gap may not necessarily be provided.

Movable element 32 is a movable core having a circular columnar shape and is positioned below stationary element 33. An upper end surface of movable element 32 faces a lower end surface of stationary element 33 in upward and downward directions 1001A. An outer diameter of movable element 32 is smaller than an inner diameter of tubular body 4 (i.e., on outer diameter of hollow 4C). Movable element 32 moves in hollow 4C which is the inside of tubular body 4 in upward and downward directions 1001A. That is, movable element 32 is configured to move between positions P3 and P4. Position P3 is a position where the upper end surface of movable element 32 contacts the lower end surface of stationary element 33. Position P4 is a position where the upper end surface of movable element 32 is separated from the lower end surface of stationary element 33.

Restoring spring 35 is a coil spring disposed inside stationary element 33. Restoring spring 35 is pressed against the upper end surface of movable element 32 and compressed to generate a downward elastic force. Press-contact spring 36 is a coil spring disposed between yoke part 341 and movable contactor 25. Press-contact spring 36 is pressed by movable contactor 25 and is compressed to generate an upward elastic force.

Shaft 37 is made of nonmagnetic material and has a circular rod shape extending in the upward and downward direction. Shaft 37 is inserted into hole 344 formed in the central part of yoke part 341 and into hole 251 formed in the central part of movable contactor 25. Shaft 37 passes through stationary element 33 and the inside of restoring spring 35. A lower end of shaft 37 is fastened to movable element 32. An upper end of shaft 37 has retaining part 371 unitarily formed. An outer diameter of retaining part 371 is larger than that of hole 251 of movable contactor 25. Shaft 37 moves in upward and downward directions 1001A following movable element 32 moving in upward and downward directions 1001A.

Electromagnet device 3 may include a housing that accommodates movable element 32 and stationary element 33. The housing has an opening provided in an upper surface thereof and has a cylindrical shape with a bottom. The circumferential periphery of the opening which is the upper end of the housing is fastened to yoke part 34. The bottom of the housing is fitted into hollow 4C inside tubular body 4. Accordingly, the housing limits a moving direction of movable element 32 to upward and downward directions 1001A and regulates position P4 of movable element 32.

The housing, the case and the coupler, described above, preferably constitute an airtight container forming an airtight space therein. The airtight container is preferably filled with an arc-extinguishing gas mainly containing hydrogen. Even if an arc occurs when movable contacts 22A and 22B separate from fixed contacts 21A and 21B, the arc-extinguishing gas rapidly cools and quickly extinguishes the arc. In electromagnetic relay 1A according to the embodiment, the airtight container may preferably accommodate therein fixed contacts 21A and 21B and movable contacts 22A and 22B.

In electromagnetic relay 1A according to the embodiment, the upper end of permanent magnet 40 is magnetized as an N-pole while the lower end thereof is polarized as an S-pole. Hence, permanent magnet 40 generates magnetic flux ϕ2 in a direction passing through tubular part 42, movable element 32, stationary element 33, yoke part 341, yoke part 343B (343A), yoke part 342, and tubular part 41 in this order. The direction of magnetic flux ϕ2 is identical to that of magnetic flux ϕ1 generated by coil 31. The upper end of permanent magnet 40 may be magnetized as an S-pole while the lower end thereof is polarized as N-pole. In this case, the direction of a current supplied to coil 31 is reversed so as to cause the direction of magnetic flux ϕ1 to agree with the direction of magnetic flux ϕ2.

Permanent magnet 40 can function as a magnetic gap for magnetic flux ϕ1. According to this embodiment, when movable contacts 22A and 22B are positioned at positions P1 and P2, tubular parts 41 and 42 of tubular body 4 face movable element 32 in direction 4F perpendicular to center axis direction 4E. Hence, magnetic flux ϕ1 hardly passes through permanent magnet 40 and tubular part 42, but passes mainly through tubular part 41 and then through movable element 32. Both magnetic fluxes ϕ1 and ϕ2 pass through the gap between movable element 32 and stationary element 33, which generates a magnetic attractive force so as to shorten the gap between movable element 32 and stationary element 33 due to magnetic fluxes ϕ1 and ϕ2.

A basic operation of electromagnetic relay 1A according to this embodiment will be described below. First, an operation of electromagnetic relay 1A while coil 31 is not energized (non-energized state) will be described. In this case, although magnetic flux ϕ2 generated by permanent magnet 40 causes a magnetic attractive force between movable element 32 and stationary element 33, movable element 32 is positioned at position P4 due to a larger elastic force generated by restoring spring 35. At this moment, retaining part 371 of shaft 37 presses movable contactor 25 downward. Hence, retaining part 371 restricts an upward movement of movable contactor 25, and positions movable contacts 22A and 22B at the open position (position P2), which is separate from both fixed contacts 21A and 21B. In the case that contactor 2 opens, contact bases 23 and 24 are disconnected from each other.

Next, an operation of electromagnetic relay 1A in the case that coil 31 is energized will be described. In this state, magnetic flux ϕ1 generated by coil 31 and magnetic flux ϕ2 generated by permanent magnet 40 cause a magnetic attractive force between movable element 32 and stationary element 33. The magnetic attractive force is larger than the elastic force of restoring spring 35. Hence, movable element 32 is attracted upward against the elastic force of restoring spring 35 to move to position P3 where movable element 32 contacts stationary element 33. Then, shaft 37 and retaining part 371 working in conjunction with movable element 32 are pulled upward, and retaining part 371 releases the restriction of the upward movement of movable contactor 25. Accordingly, movable contactor 25 is pressed upward due to an elastic force of press-contact spring 36 to position movable contacts 22A and 22B to the closed position (position P1) to allow where movable contacts 22A and 22B to contact fixed contacts 21A and 21B, respectively. This is a state where contactor 2 is closed, and contact bases 23 and 24 are connected to each other.

When energization of coil 31 is suspended in this state, the magnetic attractive force due to magnetic flux ϕ1 generated by coil 31 disappears, allowing the elastic force of restoring spring 35 to exceed the magnetic attractive force. Hence, movable element 32 is pressed down by restoring spring 35 to move to position P4. Then, retaining part 371 and shaft 37 operating in conjunction with movable element 32 is pulled downward. Hence, movable contactor 25 is pressed downward against an elastic force of press-contact spring 36. Accordingly, movable contacts 22A and 22B are positioned at the open position (position P2). This is a state where contactor 2 opens; contact bases 23 and 24 are disconnected from each other.

That is, electromagnet device 3 is configured to attract movable element 32 by magnetic fluxes ϕ1 and ϕ2 while coil 31 is energized. Then, electromagnet device 3 is configured to move movable contacts 22A and 22B from the open position (position P2) at which the movable contacts are separated from fixed contacts 21A and 21B to the closed position (position P1) at which movable contacts 22A and 22B contact fixed contacts 21A and 21B following the attraction of movable element 32. Electromagnet device 3 is configured to move movable contacts 22A and 22B from the closed position (position P1) to the open position (position P2) when energization of coil 31 is suspended. Thus, electromagnetic relay 1A according to this embodiment is a monostable a-contact relay where contactor 2 closes upon energization of coil 31, and opens upon non-energization of coil 31 (refer to JIS C 4540-1).

Electromagnetic relay 1A according to the embodiment may be a monostable b-contact relay where contactor 2 opens upon energization of coil 31 and opens upon non-energization of coil 31. In this configuration, the open position is position P1 while the closed position is position P2. More specifically, electromagnet device 3 is configured to move movable contacts 22A and 22B from the closed position (position P2) at which movable contacts 22A and 22B contact fixed contacts 21A and 21B to the open position (position P1) at which the movable contacts are separated from both fixed contacts 21A and 21B, following the attraction of movable element 32 in an energized state of coil 31. Electromagnet device 3 is configured to move movable contacts 22A and 22B from the open position (position P1) to the closed position (position P2) when energization of coil 31 is suspended.

As described above, electromagnetic relay 1A according to this embodiment increases a magnetic attractive force between movable element 32 and stationary element 33 by adding magnetic flux ϕ2 generated by permanent magnet 40 to magnetic circuit 34A passing magnetic flux ϕ1 generated by coil 31. That is, electromagnet device 3 attracts movable element 32 by magnetic fluxes ϕ1 and ϕ2 to move movable contacts 22A and 22B to position P1 upon energizing of coil 31. Hence, if the magnetic attractive force required for closing contactor 2 is at the same level, magnetic flux ϕ1 smaller by the amount of magnetic flux ϕ2 is required. In other words, in electromagnetic relay 1A according to this embodiment, a smaller current flowing through coil 31 is only required, reducing power consumption. Further, electromagnetic relay 1A according to this embodiment only requires a small amount of magnetic flux ϕ1, and thus coil 31 can have a small size, reducing the size and weight of the relay.

Here, the conventional electromagnetic relay disclosed in PTL 1 includes a permanent magnet unitarily with a movable core and provides the following problems.

First, the conventional electromagnetic relay needs to change the shape and size of the movable core, causing difficulty in designing. Further, the conventional electromagnetic relay has a complicated structure for incorporating a permanent magnet into a movable core, which requires a higher dimensional accuracy for the movable core and permanent magnet that may increase costs.

Second, in the conventional electromagnetic relay, the mass of the permanent magnet is added to that of the movable core, and thus the movable iron core contacts the fixed core with a stronger impact and the electromagnetic relay operates with a large noise.

Third, to design a small and powerful electromagnet device, the movable core needs at least a certain amount of volume and at least a certain amount of area that faces the fixed core. However, the conventional electromagnetic relay hardly provides such a volume and area since the permanent magnet is incorporated into the movable core.

Fourth, in order to extend a life time and to increase the cutoff performance and the conducting performance of a contact, an electromagnetic relay including the movable core and the fixed core, needs to have an airtight space. A conventional electromagnetic relay, however, is structured to incorporate the permanent magnet into the movable core, and thus the permanent magnet is disposed inside the airtight space. Accordingly, the conventional electromagnetic relay needs to be designed to have a larger airtight space due to a larger movable core that incorporates the permanent magnet. A larger airtight space requires technically more difficult designing and higher cost.

In electromagnetic relay 1A according to this embodiment, permanent magnet 40 is formed as a part of tubular body 4 to solve the above-described problems. As to the first problem, in electromagnetic relay 1A according to the embodiment with permanent magnet 40 being a part of tubular body 4, permanent magnet 40 does not need to be incorporated into movable element 32. Accordingly, electromagnetic relay 1A according to the embodiment does not need to be designed to change the shape and the size of movable element 32 and requires lower dimensional accuracy of movable element 32 and permanent magnet 40 than the conventional electromagnetic relay. Consequently, electromagnetic relay 1A according to the embodiment is designed more easily than the conventional relay, and does not increase the cost, which eliminates the first problem.

In short, electromagnetic relay 1A according to the embodiment with permanent magnet 40 composing a part of tubular body 4 is designed easily and achieves lower power consumption while reducing cost compared to the conventional electromagnetic relay with a permanent magnet provided unitarily with a movable core.

As to the second problem, permanent magnet 40 does not need to be incorporated into movable element 32 in electromagnetic relay 1A according to the embodiment, and thus, the mass of permanent magnet 40 is not added to that of movable element 32. Accordingly, in electromagnetic relay 1A according to the embodiment, movable element 32 contacts stationary element 33 with a smaller impact than the conventional electromagnetic relay, and electromagnetic relay 1A operates with a smaller noise. Consequently, electromagnetic relay 1A according to the embodiment eliminates the second problem. Further, the conventional electromagnetic relay includes the permanent magnet incorporated into the movable core, which is more subject to an impact. Meanwhile, electromagnetic relay 1A according to the embodiment includes permanent magnet 40 incorporated into neither movable element 32 nor stationary element 33. Accordingly, in electromagnetic relay 1A according to the embodiment, an impact produced when movable element 32 contacts stationary element 33 is hardly transferred to permanent magnet 40, resulting in a high impact resistance of permanent magnet 40.

As to the third problem, electromagnetic relay 1A according to the embodiment which does not need to incorporate permanent magnet 40 into movable element 32 allows at least a certain amount of volume and at least a certain amount of area that faces the fixed core more easily than the conventional electromagnetic relay. Consequently, electromagnetic relay 1A according to the embodiment eliminates the third problem.

As to the fourth problem, electromagnetic relay 1A according to the embodiment includes permanent magnet 40 as a part of tubular body 4, and thus, permanent magnet 40 is disposed outside the airtight space. Hence, in electromagnetic relay 1A according to the embodiment, even if movable element 32 and stationary element 33 are accommodated in the housing and are sealed to form an airtight space, permanent magnet 40 does not influence the design of the airtight space. Consequently, in electromagnetic relay 1A according to the embodiment, an airtight space is designed more easily than the conventional electromagnetic relay, and does not increase the cost, which eliminates the fourth problem.

In electromagnetic relay 1A according to the embodiment, permanent magnet 40 is a part of tubular body 4, and thus, as shown in FIG. 2, permanent magnet 40 is disposed near the gap between movable element 32 and stationary element 33. Accordingly, electromagnetic relay 1A according to the embodiment allows magnetic flux $\phi 2$ to put into the gap easily, increasing the magnetic efficiency of magnetic circuit 34A.

Further, electromagnetic relay 1A according to the embodiment can have movable element 32 with a smaller mass than the conventional electromagnetic relay. Accordingly, even if an impact is applied to electromagnetic relay 1A according to of the embodiment, the displacement of movable element 32 due to the impact is suppressed, increasing the impact resistance.

Magnetic flux $\phi 2$ passing through magnetic circuit 34A through which magnetic flux $\phi 1$ passes allows permanent magnet 40 to be provided as a part of, e.g. yoke 34. This configuration, however, causes permanent magnet 40 to be disposed outside coil 31, resulting in providing permanent magnet 40 with a large size. Meanwhile, in electromagnetic relay 1A according to the embodiment, permanent magnet 40 is provided as a part of tubular body 4 that is inserted into the inside of coil 31. Accordingly, permanent magnet 40 is disposed inside coil 31, hence having a smaller size than the case where permanent magnet 40 is provided as a part of yoke 34.

In electromagnetic relay 1A according to the embodiment, permanent magnet 40 is provided between tubular parts 41 and 42 that are made of magnetic material. Accordingly, magnetic flux $\phi 2$ generated by permanent magnet 40 passes through tubular parts 41 and 42, as shown in FIG. 2. Consequently, magnetic flux $\phi 2$ generated by permanent magnet 40 leaks less than an electromagnetic relay that does not include tubular parts 41 and 42, thereby increasing magnetic efficiency of magnetic circuit 34A.

Figure 3:
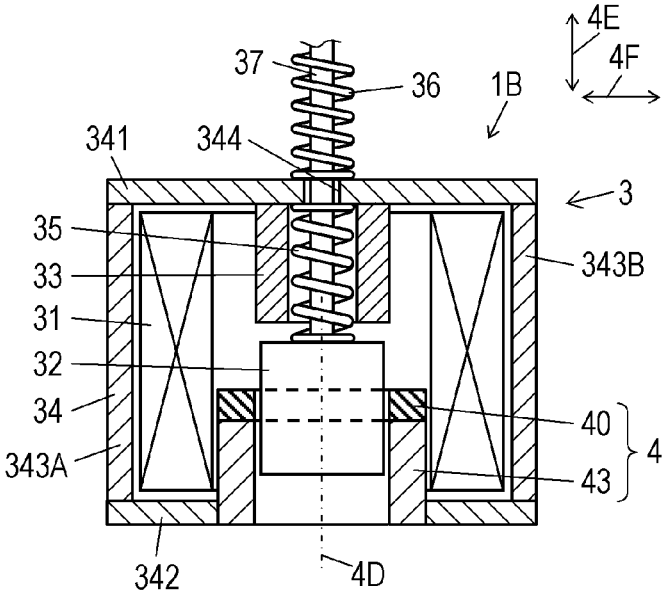
FIG. 3 is a schematic cross-sectional view of another electromagnetic relay according to the embodiment.

FIG. 3 is a schematic cross-sectional view of another electromagnetic relay 1B according to the embodiment. In FIG. 3, components identical to those of electromagnetic relay 1A shown in FIGS. 1A and 1B are denoted by the same reference numerals. In electromagnetic relay 1B shown in FIG. 3, tubular body 4 includes tubular part 43 and permanent magnet 40, and permanent magnet 40 is provided at the upper end of tubular body 4. Tubular part 43 is made of magnetic material and has a cylindrical shape. The lower end of tubular body 4 (an end of tubular body 4 in axial direction 31A of coil 31, i.e., in center axis direction 4E) is connected to yoke 34 (yoke part 342). Then, permanent magnet 40 is fastened to the upper end of tubular part 43. In other words, tubular body 4 is configured such that tubular part 43 and permanent magnet 40 are disposed in this order from the lower end (one end of tubular body 4 in axial direction 31A of coil 31, i.e., in center axis direction 4E). That is, tubular part 43 is positioned between permanent magnet 40 and the lower end (one end of tubular body 4 in axial direction 31A of coil 31) of tubular body 4 in center axis direction 4E of tubular body 4. When movable contacts 22A and 22B are positioned at positions P1 and P2, tubular part 43 of tubular body 4 faces movable element 32 in direction 4F perpendicular to center axis direction 4E. This configuration proves the same effects of electromagnetic relay 1A shown in FIGS. 1A and 1B. In electromagnetic relay 1B, tubular body 4 is composed of a total of two components: tubular part 43 and permanent magnet 40, and thus, can be produced with a smaller number of components and lower cost than electromagnetic relay 1A shown in FIGS. 1A and 1B.

Figure 4:
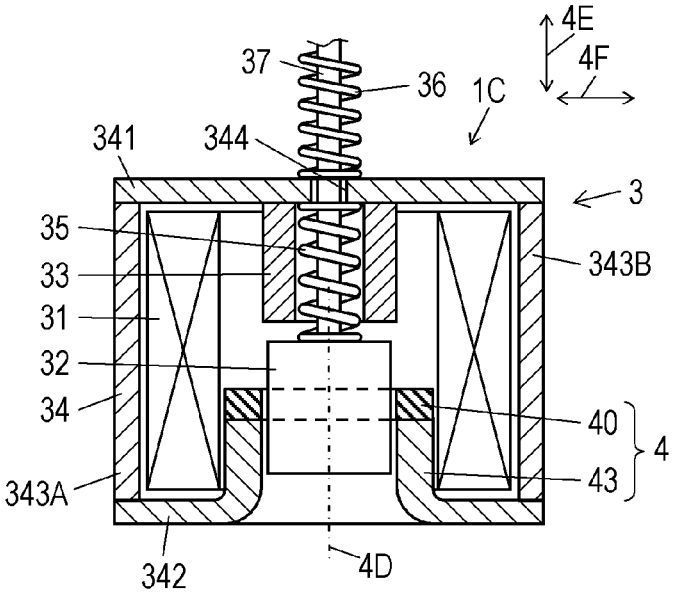
FIG. 4 is a schematic cross-sectional view of still another electromagnetic relay according to the embodiment.

FIG. 4 is a schematic cross-sectional view of still another electromagnetic relay 1C according to the embodiment. In FIG. 4, components identical to those of electromagnetic relay 1B shown in FIG. 3 are denoted by the same reference numerals. In electromagnetic relay 1C shown in FIG. 4, tubular part 43 is formed unitarily with yoke 34 (yoke part 342) seamlessly. Tubular part 43 can be jointed to yoke part 342 seamlessly by yoke part 342 by, e.g. drawing or burring. This configuration provides a narrower gap between tubular part 43 and yoke part 342 than the case where there is a seam between tubular part 43 and yoke part 342. Consequently, this configuration with a narrower gap enhances the magnetic efficiency of magnetic circuit 34A to increase a magnetic attractive force between movable element 32 and stationary element 33.

Here, yoke parts 343A and 343B, besides tubular part 43, may be unitarily formed with yoke part 342 seamlessly. This configuration also provides a narrower gap between yoke part 342 and each of yoke parts 343A and 343B, which further enhances the magnetic efficiency of magnetic circuit 34A to furthermore increase the magnetic attractive force between movable element 32 and stationary element 33.

Figure 5:
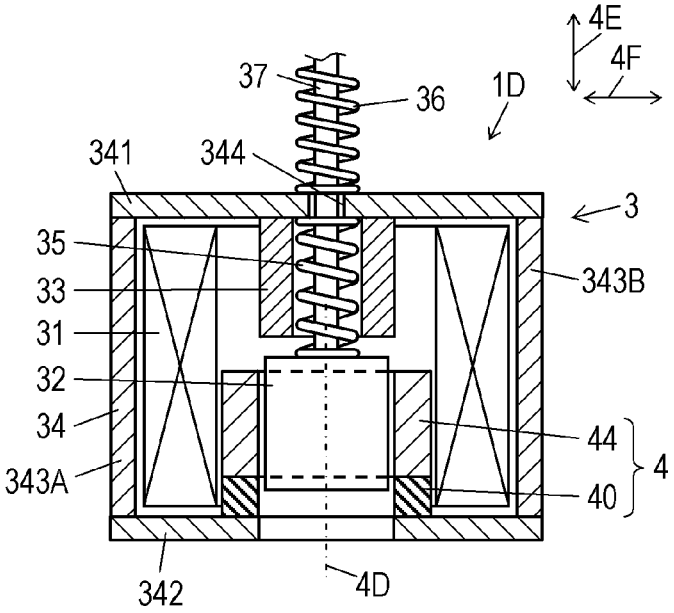
FIG. 5 is a schematic cross-sectional view of a further electromagnetic relay according to the embodiment.

FIG. 5 is a schematic cross-sectional view of further electromagnetic relay 1D according to the embodiment. In FIG. 5, components identical to those of electromagnetic relay 1A shown in FIGS. 1A and 1B are denoted by the same reference numerals. In electromagnetic relay 1D shown in FIG. 5, tubular body 4 is composed of tubular part 44 and permanent magnet 40. Permanent magnet 40 is provided at the lower end of tubular body 4. Tubular part 44 is made of magnetic material and has a cylindrical shape. The lower end of tubular body 4 (an end of tubular body 4 in axial direction 31A of coil 31, i.e., in center axis direction 4E) is connected to yoke 34 (yoke part 342). Permanent magnet 40 is provided between tubular part 44 and yoke part 342. In other words, tubular body 4 is configured such that permanent magnet 40 and tubular part 44 are disposed in this order from the lower end (one end of tubular body 4 in axial direction 31A of coil 31, i.e., in center axis direction 4E), in center axis direction 4E of tubular body 4. That is, permanent magnet 40 is positioned between the lower end (one end of tubular body 4 in axial direction 31A of coil 31, i.e., in center axis direction 4E) of tubular body 4 and tubular part 44, in center axis direction 4E of tubular body 4. This configuration also provides the same effects as electromagnetic relay 1A shown in FIGS. 1A and 1B. In electromagnetic relay 1D, tubular body 4 is composed of a total of two components: tubular part 44 and permanent magnet 40, and thus electromagnetic relay 1D can be produced with a smaller number of components and lower cost than electromagnetic relay 1A shown in FIGS. 1A and 1B.

Figure 6:
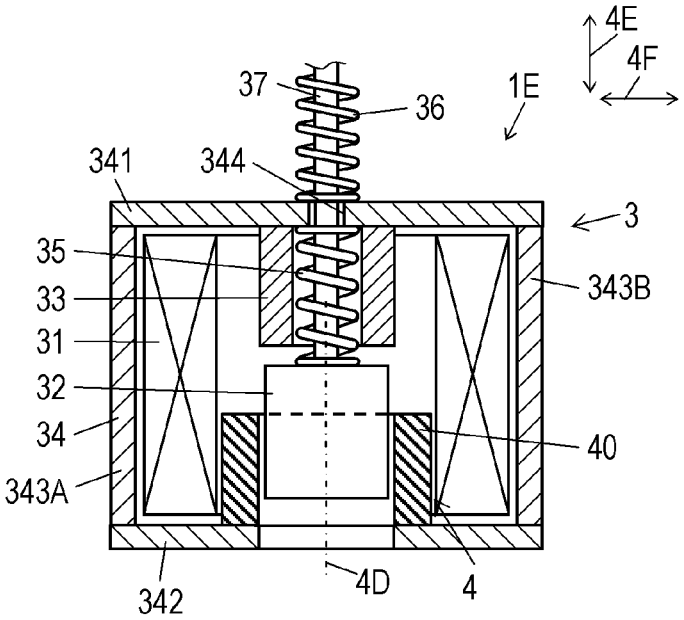
FIG. 6 is a schematic cross-sectional view of a further electromagnetic relay according to the embodiment.

FIG. 6 is a schematic cross-sectional view of further electromagnetic relay 1E according to the embodiment. In FIG. 5, components identical to those of electromagnetic relay 1A shown in FIGS. 1A and 1B are denoted by the same reference numerals. In electromagnetic relay 1E shown in FIG. 6, tubular body 4 is composed of permanent magnet 40. That is, permanent magnet 40 constitutes both upper and lower ends of tubular body 4, thus constituting entire tubular body 4. This configuration also provides the same effects as electromagnetic relay 1A shown in FIGS. 1A and 1B. In this configuration, tubular body 4 is composed only of permanent magnet 40, and thus, electromagnetic relay 1E can be produced with a smaller number of components and lower cost than electromagnetic relay 1A that has tubular part 43 and tubular part 44.

In electromagnetic relays 1A to 1E according to the embodiment, movable contactor 25 includes movable contacts 22A and 22B, which is not intended to limit the disclosure to this configuration. For example, parts of movable contactor 25 may function as movable contacts 22A and 22B.

Figure 7:
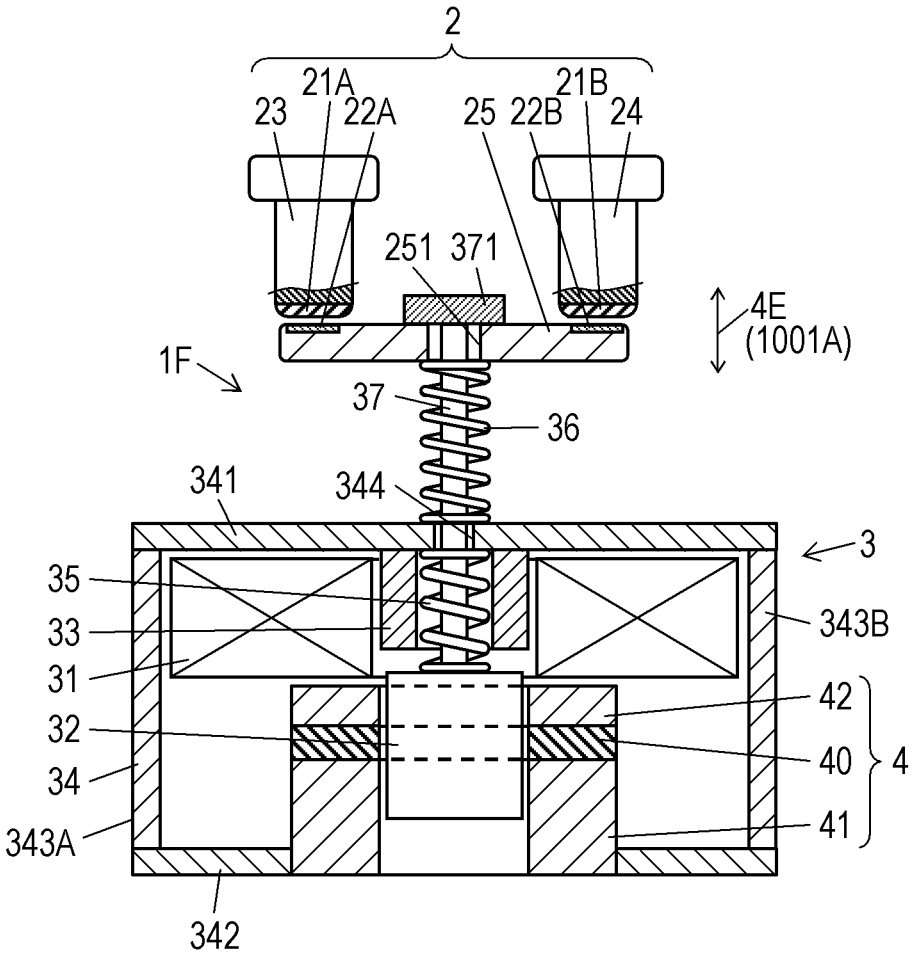
FIG. 7 is a schematic cross-sectional view of a further electromagnetic relay according to the embodiment.

FIG. 7 is a schematic cross-sectional view of further electromagnetic relay 1F according to the embodiment. In FIG. 7, components identical to those of electromagnetic relay 1A shown in FIGS. 1A and 1B are denoted by the same reference numerals. In electromagnetic relays 1A to 1E according to the embodiment shown in FIGS. 1A to 6, coil 31 is disposed such that movable element 32, stationary element 33, and tubular body 4 are positioned inside coil 31, which is not intended to limit the position of coil 31. In electromagnetic relay 1F shown in FIG. 7, coil 31 is disposed at a position away from the vicinity of tubular body 4. This configuration allows coil 31 to be disposed using the space (refer to FIG. 1A) between coil 31 and stationary element 33, the space being unused due to the presence of tubular body 4. In this configuration, coil 31 is not disposed in the space around tubular body 4. This space decreases the height of tubular body 4 (the length in upward and downward directions 1001A) instead of increasing a footprint of tubular body 4 within the plane perpendicular to upward and downward directions 1001A. This configuration reduces the height of tubular body 4 and reduces the height of electromagnetic relay 1F accordingly.

Figure 8B:
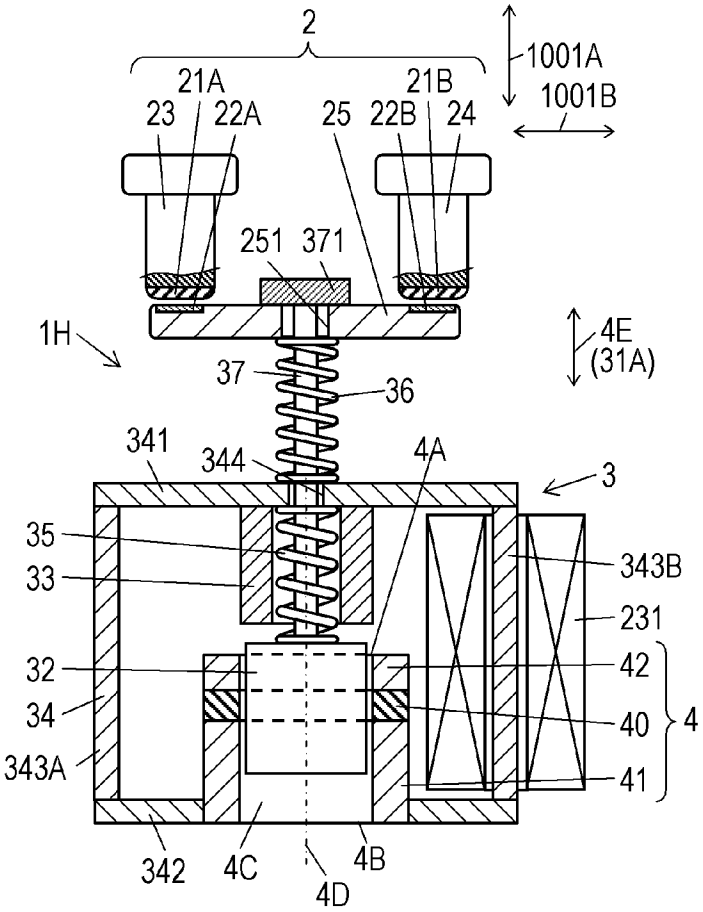
FIG. 8B is a schematic cross-sectional view of a further electromagnetic relay according to the embodiment.
Figure 8A:
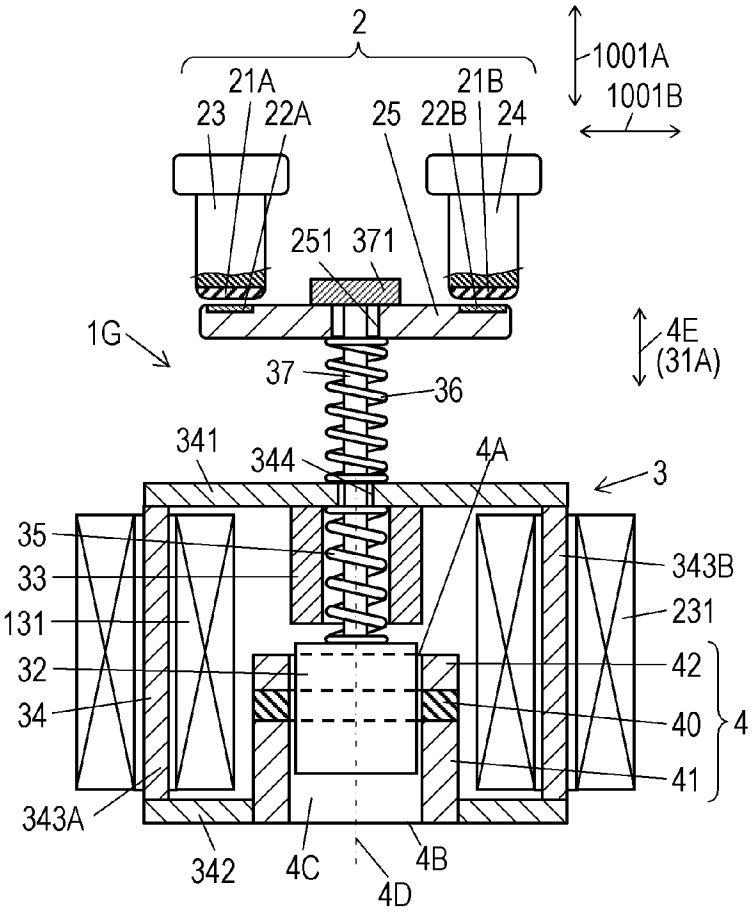
FIG. 8A is a schematic cross-sectional view of a further electromagnetic relay according to the embodiment.

FIG. 8A is a schematic cross-sectional view of further electromagnetic relay 1G according to the embodiment. In FIG. 8A, components identical to those of electromagnetic relay 1A shown in FIGS. 1A and 1B are denoted by the same reference numerals. In electromagnetic relay 1G shown in FIG. 8A, coil 131 is wound around yoke part 343A on the left, and coil 231 is wound around yoke part 343B on the right, instead of coil 31. This configuration reduces the depth of electromagnetic relay 1G (the length in the depth direction from the paper surface of FIG. 8A).

FIG. 8B is schematic cross-sectional view of further electromagnetic relay 1H according to the embodiment. In FIG. 8B, components identical to those of electromagnetic relay 1G shown in FIG. 8A are denoted by the same reference numerals. In electromagnetic relay 111 shown in FIG. 8B, coil 231 is wound only around yoke part 343B while coil 131 is not wound around yoke part 343A. This reduces the number of components of the relay.

Even if the position of coil 31 (131, 231) is changed as described above, magnetic flux $\phi$1 generated by coil 31 passes through magnetic circuit 34A composed of movable element 32, stationary element 33, yoke 34, and tubular body 4.

In the above embodiment, terms, such as "above," "below," "upper surface," "lower surface," "upper end," and "lower end", indicate directions indicate relative directions depending only on relative positional relationships of components of electromagnetic relays 1A to 1H, and do not indicate absolute directions, such as a vertical direction.

INDUSTRIAL APPLICABILITY

An electromagnetic relay according to the present invention is designed easily, and provides lower power consumption while reducing cost, and thus, is useful for various types of control devices.

REFERENCE MARKS IN THE DRAWINGS

1A-1H electromagnetic relay
2 contactor
3 electromagnet device
4 tubular body
4C hollow
4D center axis
4E center axis direction
21A, 21B fixed contact
22A, 22B movable contact
31 coil
32 movable element
33 stationary element
33P gap
34A magnetic circuit
34 yoke
40 permanent magnet
41 tubular part (first tubular part)
42 tubular part (second tubular part)
43 tubular part
44 tubular part
131 coil
231 coil
P1 position (first position)
P2 position (second position)
$\phi$1 magnetic flux (first magnetic flux)
$\phi$2 magnetic flux (second magnetic flux)

What is claimed is:

1. An electromagnetic relay comprising:

a contactor including a fixed contact and a movable contact; and an electromagnet device for moving the movable contact, wherein the electromagnet device includes:

a coil generating a first magnetic flux upon energization thereof, the coil being wound about a center axis thereof that extends through an inside of the coil;

a tubular body including a permanent magnet generating a second magnetic flux in a direction identical to a direction of the first magnetic flux, the tubular body having a hollow extending in a center axis direction along the center axis of the coil;

a movable element disposed in the hollow of the tubular body and reciprocating in the center axis direction; and a yoke forming a magnetic circuit passing together with the movable element and the tubular body, the magnetic circuit allowing at least one of the first magnetic flux and the second magnetic flux to pass through the magnetic circuit, wherein the permanent magnet is disposed in the inside of the coil, and wherein the electromagnet device is configured to:

when the coil is energized, move the movable contact to a first position by attracting the movable element with the first magnetic flux and the second magnetic flux; and when energization of the coil is suspended, move the movable contact to a second position different from the first position.

2. The electromagnetic relay of claim 1, wherein the tubular body further includes a first tubular part and a second tubular part which are made of magnetic material, and wherein the permanent magnet is provided between the first tubular part and the second tubular part in the center axis direction.

3. The electromagnetic relay of claim 2, wherein the first tubular part and the second tubular part of the tubular body faces the movable element in a direction perpendicular to the center axis direction when the movable contact is positioned at the first position and at the second position.

4. The electromagnetic relay of claim 1, wherein the tubular body has a tubular part made of magnetic material, wherein one end of the tubular body in the center axis direction is connected to the yoke, and wherein the tubular part of the tubular body is disposed between the one end of the tubular body and the permanent magnet in the center axis direction.

5. The electromagnetic relay of claim 4, wherein the tubular part of the tubular body faces the movable element in a direction perpendicular to the center axis direction when the movable contact is positioned at the first position and at the second position.

6. The electromagnetic relay of claim 4, wherein the tubular part is seamlessly connected to the yoke.

7. The electromagnetic relay of claim 6, wherein the tubular part is formed unitarily with the yoke.

8. The electromagnetic relay of claim 1, wherein the tubular body has a tubular part made of magnetic material, wherein one end of the tubular body in the center axis direction is connected to the yoke, and wherein the permanent magnet is disposed between the one end of the tubular body and the tubular part in the center axis direction.

9. The electromagnetic relay of claim 1, wherein the permanent magnet constitutes an entirety of the tubular body.

10. The electromagnetic relay of claim 1, wherein the electromagnet device further includes a stationary element facing the movable element across a gap, the stationary element forming the magnetic circuit together with the tubular body, the movable element, and the yoke, and wherein the direction of the first magnetic flux in the gap is identical to a direction of the second magnetic flux in the gap.

* * * * *